United States Patent [19]

Sakamaki et al.

[11] 4,198,195

[45] Apr. 15, 1980

[54] ROTARY FLUID PUMP OR COMPRESSOR

[75] Inventors: Hiroshi Sakamaki, Tochigi; Toshiyuki Maeda, Ageo; Fumihiro Ushijima; Tadashi Saitou, both of Toyota, all of Japan

[73] Assignees: Nippon Piston Ring Co., Ltd., Tokyo; Toyota Jidosha Kogyo Kabushiki Kaisha, Toyota, both of Japan

[21] Appl. No.: 849,912

[22] Filed: Nov. 9, 1977

[30] Foreign Application Priority Data

Nov. 9, 1976 [JP] Japan ..... 51-134448

[51] Int. Cl.[2] ..... F04C 27/00

[52] U.S. Cl. ..... 418/133; 418/152

[58] Field of Search ..... 418/152, 133, 131, 132, 418/135, 142; 417/DIG. 1

[56] References Cited

U.S. PATENT DOCUMENTS 2,491,678 12/1949 McCulloch et al. ..... 418/152 X
3,128,710 4/1964 Blomgren et al. ..... 418/152 X
3,191,852 6/1965 Kaatz et al. ..... 417/DIG. 1
3,847,518 11/1974 Prasse et al. ..... 418/152 X

FOREIGN PATENT DOCUMENTS 2555595 6/1976 Fed. Rep. of Germany ..... 418/133

*Primary Examiner*—Leonard E. Smith
*Attorney, Agent, or Firm*—Sughrue, Rothwell, Mion, Zinn and Macpeak

[57] ABSTRACT

A dry rotary fluid pump or compressor includes a rotor eccentrically supported in a rotor chamber generally defined by a stator housing and two end heads. Two side plates each interposed between the housing and each of the end heads form end chambers between the respective side plates and end heads. The end chambers are supplied with a pressure higher than that of the rotor chamber so as to bring the side plates into close contact with opposite side faces of the rotor. The side plates are formed of a material having an abrasion resistance higher than that of at least the opposite side faces of the rotor.

3 Claims, 12 Drawing Figures

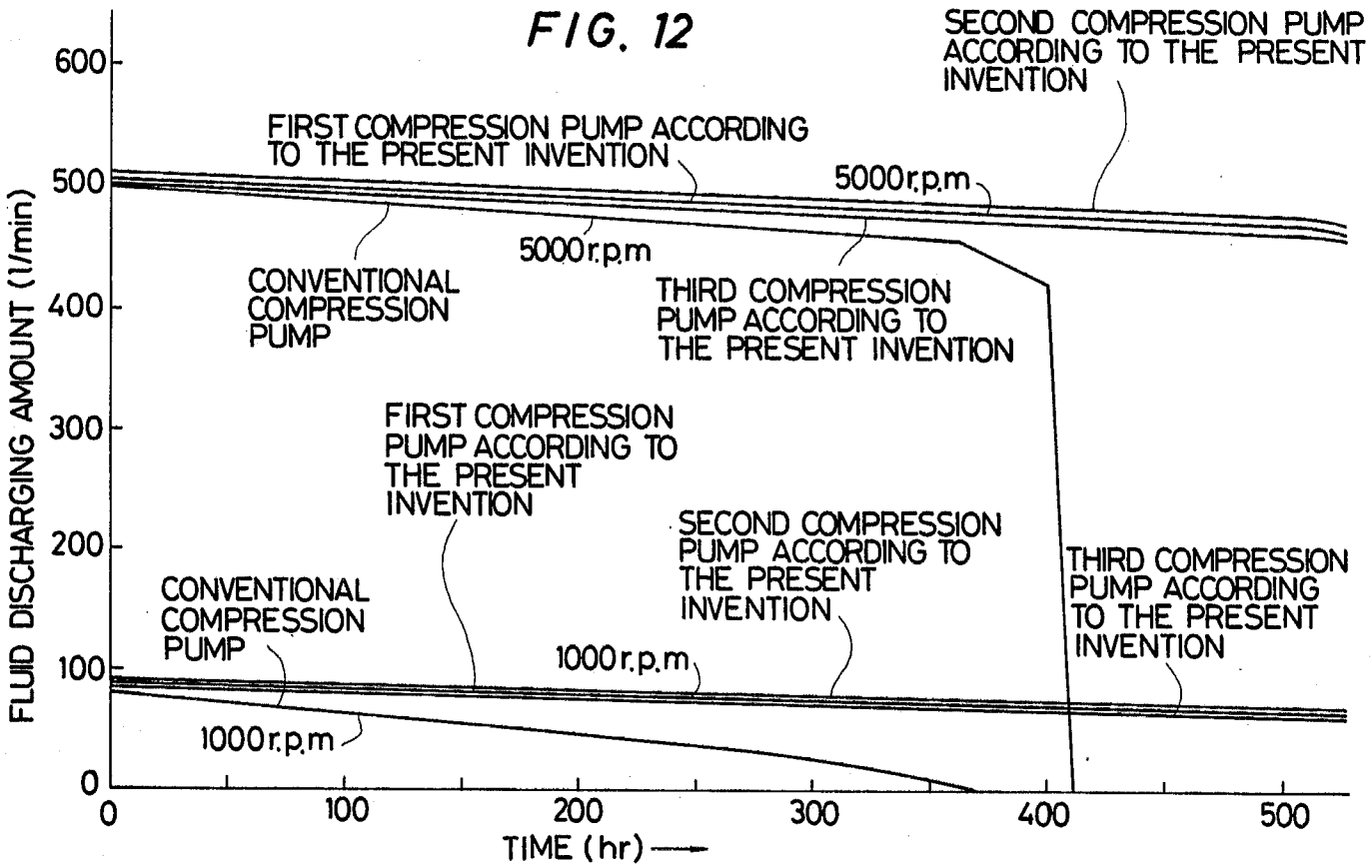
FIG. 12
SECOND COMPRESSION PUMP ACCORDING TO THE PRESENT INVENTION
5000r.p.m
FIRST COMPRESSION PUMP ACCORDING TO THE PRESENT INVENTION
5000r.p.m
THIRD COMPRESSION PUMP ACCORDING TO THE PRESENT INVENTION
CONVENTIONAL COMPRESSION PUMP
FIRST COMPRESSION PUMP ACCORDING TO THE PRESENT INVENTION
SECOND COMPRESSION PUMP ACCORDING TO THE PRESENT INVENTION
1000r.p.m
THIRD COMPRESSION PUMP ACCORDING TO THE PRESENT INVENTION
CONVENTIONAL COMPRESSION PUMP
1000r.p.m
FLUID DISCHARGING AMOUNT (l/min)
600
500
400
300
200
100
0
0
100
200
300
400
500
TIME (hr)

ROTARY FLUID PUMP OR COMPRESSOR

BACKGROUND OF THE INVENTION

This invention relates to a rotary fluid pump or compressor having side plates which are relatively free from wear to provide good outwardly radial sliding movement of the vanes and good sealability and, more particularly, to a rotary fluid pump or compressor having its side plates formed of a material having a wear resistance higher than that of the rotor.

A nagging and persistant problem in the design of rotary pumps and compressors has been to adequately seal the axial ends of the working chamber at the sliding interfaces between the rotor and the stator housing. Any leakage at such seals tends to compromise the pump efficiency or compression ratio, and the problem is particularly onerous owing to the axial expansion pressures developed in the working chamber during operation.

U.S. Pat. No. 2,702,509 attempts to provide a rotary pump having a pair of resilient sealing membranes disposed at the opposite ends of the rotor to prevent fluid leakage from the end faces thereof. Since the membranes do not follow the axial movement or inclination of the end faces of the rotor, however, satisfactory sealing is not always obtained.

To overcome this drawback, according to U.S. Pat. Nos. 2,558,837 and 2,833,465, loose pads are provided at the end faces of the rotor and are urged there against by biasing springs. The pads tightly contact the rotor and may rotate together therewith, however, and the rotor shaft extending through receiving holes in the pads tends to damage and wear them.

In U.S. Pat. No. 3,695,791 a pair of bimetals are used as sealing plates to eliminate any gaps between the plates and the rotor end faces. It takes some time for the bimetals to properly thermally deform, however, whereby effective sealing is not always obtained, particularly during the initial startup period.

In order to overcome the above-mentioned drawbacks and disadvantages, the present applicant designed an improved rotary pump or compressor which is the subject of U.S. application Ser. No. 637,459, filed Dec. 3, 1975, and assigned to the assignee of this application. As shown in FIG. 1, the pump or compressor according to the prior application includes a stator housing 1 and a pair of end heads 2, 3 having recesses *2a*, *3a* therein assembled to form a pump cavity in which a rotor 6″ is disposed in a cantilevered manner on the end of a drive shaft 5 eccentrically journalled in the end head 3. A pair of flexible side plates 7′, 8′ are sealingly disposed between the side walls of the stator housing and the respective end heads 2, 3 to thereby divide the pump cavity into a pair of end chambers 9, 10 defined by the plates 7′, 8′ and recesses *2a*, *3a* and a rotor or working chamber 4. Pressurized air may be supplied to the end chambers to establish a positive pressure differential with respect to the working chamber, whereby the side plates are urged into contact with the end faces of the rotor to maintain a satisfactory working seal. When the structure is operated as a compressor, the pressure differential may be established by feedback passages from the outlet port O to the end chambers, which may take the form of simple apertures in the side plates at the upper portions of the working chamber, although such a pressure differential is not always necessary. During operation as a pump the end chambers may simply be vented to atmosphere or sealed at atmospheric pressure, whereby a pressure differential is established by the negative pressure in the inlet port I. The rotor may be of the sliding radial vane type, and with such an arrangement a working fluid is pumped or compressed between the inlet port I and the outlet port O as the shaft 5 is rotationally driven.

Several problems have still been found to exist with this type of a rotary pump construction, however. More specifically, the rotor 6″ is formed of cast iron and the side plates 7′ and 8′ are formed of a synthetic resin. According to the Japanese Utility Model application No. sho-50-26136, corresponding to British Pat. No. 1,515,635, the relationship between the inner diameter of the rotor chamber and the thickness of the side plates is described. In case the thickness of the side plates is less than the predetermined range, one part of the side plates which faces the compression stroke position is deformed toward the end chambers resulting in deteriorating sealability. While, in case the thickness of the side plates is larger than the predetermined range, the side plates may not sufficiently contact the end faces of the rotor in response to the pressure change of the rotor chamber if the pump is used as a vacuum pump also resulting in deteriorating sealability. In case the outer circumference of the side plates made of synthetic resin are embedded into the end heads, the side plates may excessively contact the end faces of the rotor due to thermal expansion of the side plates resulting in the side plates becoming excessively worn. Accordingly, the side plates may be frictionally stepped between the contacting and non-contacting locations. While in case the outer periphery of the side plates are not embedded into the end heads but just interposed between the stator housing and the end heads, a 0.6 mm stepped portion was created in the side plates when the experiment was made under the compression pump rotation of 6,000 rpm, after 500 hours of running. If the rotation is immediately reduced from 6,000 rpm to 500 to 1000 rpm, the exhaust flow is excessively reduced with time at 800 to 1,000 rpm, and therefore, such pump is not suitable to commercial use. It is apparent that if less than 0.2 mm stepped portion of the side plates is created after 500 hours of running at 6,000 rpm maintaining a high exhaust flow, such a pump would be practical for use in applications requiring rotation of 800 to 6,000 rpm. Thus, the side plates having a lower wear-resistance are subject to wear so as to be formed with stepped portions between its face in contact with the rotor and its face out of contact from the rotor after a great number of rotations. The stepped portions obstruct the radial movement of the vanes and thereby hinder the proper sliding movement of the vanes. This tendency frequently appears when the centrifugal force acting on the vane is small, that is, the rotor runs at a low rate in the range of about 500 to about 1,500 rpm. In the compression pump according to the present invention to be described hereinafter, the stepped portions of the side plates cannot be totally avoided, since the side plates are diaphragmatically contacted with the end faces of the rotor during the rotation of the rotor, and therefore, the effect caused by the stepped portion must be taken into consideration. Although one solution might be to make the side plates out of either ferrous or nonferrous metals, such side plates cannot be used without lubricant since, otherwise, seizure between the side plates and the rotor would result. Further even if both the side plates and the rotor are made of synthetic resin, the contacting pressure between the side plates and the rotor is increased due to their large thermal expansion, resulting in increasing the stepped portion and eventual thermal seizure. If the thin side plates are used to avoid this problem, then the above-mentioned drawbacks relating to deteriorating sealability due to deformation of the side plates will result.

SUMMARY OF THE INVENTION

Therefore, the present invention has for its object to provide an improved rotary fluid pump which comprises the side plates formed of a material having an abrasion resistance higher than that of at least the opposite side faces of the rotor so as to prevent wear of the side plates and to provide a smooth vane outwardly radial sliding movement thereby improving the sealing effect to the maximum extent.

The apparatus of the invention is particularly although not exclusively, adapted to be used as an internally unlubricated or dry air compressor for supplying secondary combustion air in an exhaust emission control system of an internal combustion engine, or as a vacuum booster pump in a power-assisted brake system.

BRIEF DESCRIPTION OF THE DRAWINGS

In the drawings:

FIG. 12 is a graph showing the comparison between the pumps of the present invention and the conventional pump.

DETAILED DESCRIPTION OF THE INVENTION

The dry-air rotary pump in accordance with the subject matter of the application has been developed for incorporation in motor vehicles in order to supply pneumatically actuated equipment. As is known, the speed of rotation of a motor vehicle engine varies considerably, that is to say it lies between the idling speed of rotation of approximately 500 to 1500 rpm and possibly more. For the driven rotary pump this has the following significance:

1. Even in the case of a low speed of rotation of the engine while idling a sufficient pressure or vacuum must be capable of being produced, and
2. In the case of a high speed of rotation no excessive frictional wear and seizing should occur.

We will now describe how these two requirements are fulfilled in the case of the subject matter of the application.

Figure 1:
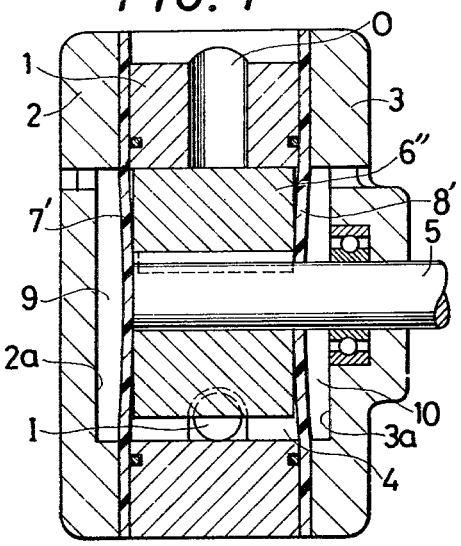
FIG. 1 shows a cross-sectional elevation of a conventional rotary pump, wherein the deformation of the side plates is exaggeratedly shown.
Figure 2:
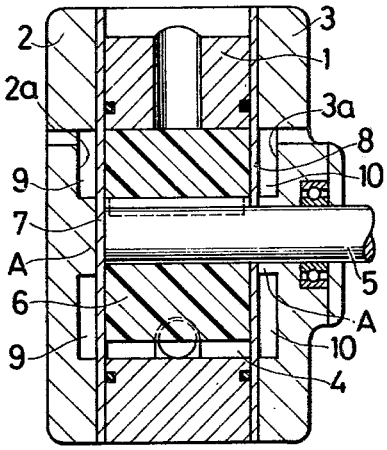
FIG. 2 shows a cross-sectional elevation of a rotary fluid pump according to a first embodiment of the present invention.
Figure 3:
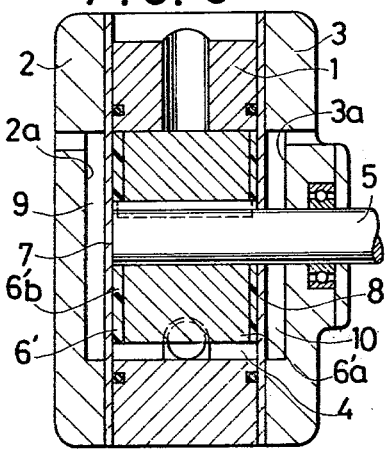
FIG. 3 shows a similar view of a second embodiment of the present invention.

Referring now to the drawings, and initially to FIG. 2, the side plates 7 and 8 are formed of a ferrous metal such as cast iron or steel or a nonferrous metal such as an aluminium alloy whereas the rotor 6 is formed of a high heat-resistive and wear-resistive synthetic resin such as polyamide resin and polyimide resin which may have incorporated therein carbon in either or both the amorphous or graphite forms. In the embodiment shown in FIG. 3, the side plates are formed of the same material as that of the first described embodiment, whereas the rotor 6' is formed of a ferrous or nonferrous metal member having affixed to its opposite side faces plates formed either of a synthetic resin which may have incorporated therein carbon in either or both the amorphous or graphite formes or plates composed mainly of carbon with a resin binder. The affixing of synthetic resin plates **6'*b* to the opposite sides faces of the ferrous or nonferrous metal member 6'*a* is preferably effected by molding to obtain a close contact. It is also preferable that the opposite side faces of the rotor member 6'*a*** have a surface roughness upon molding of more than 3S as defined by Japanese Industrial Standard JIS B0601.

Figure 4:
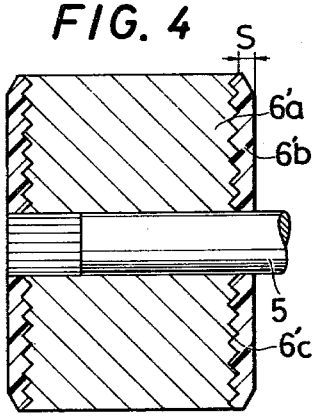
FIGS. 4 through 10 show sectional views showing rc ors used in the pump or compressor of the present invention.
Figure 5:
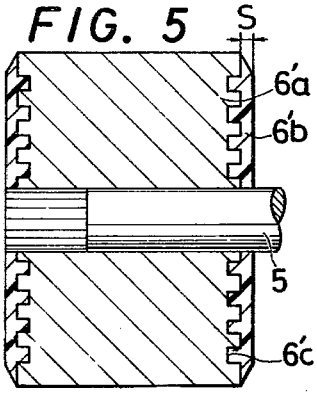
Figure 6:
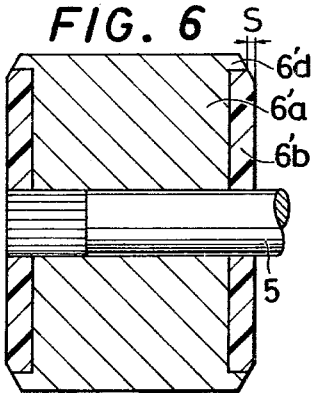
Figure 7:
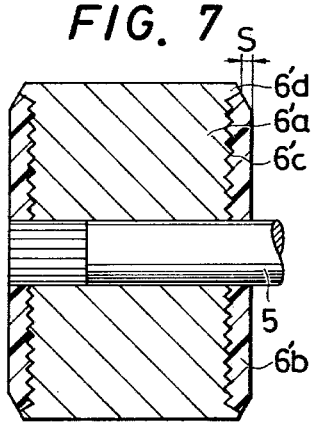
Figure 8:
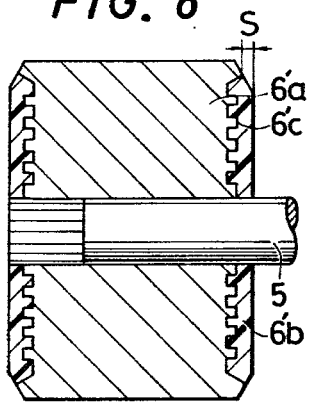
Figure 9:
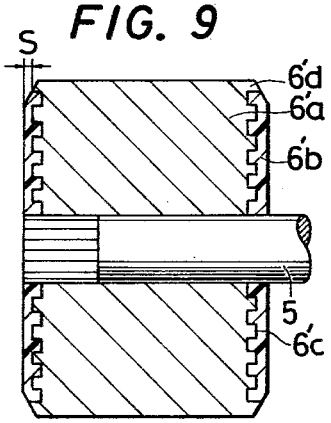
Figure 10:
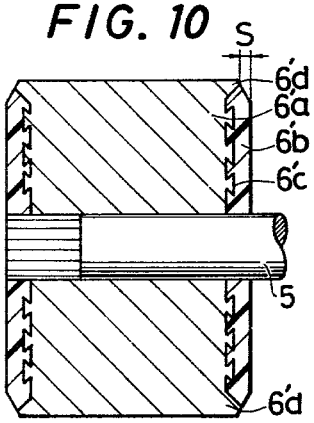

As shown in FIGS. 4 and 5, it is advantageous in improving the close contact to form in the opposite side faces of the rotor member **6'*a* coaxial annular grooves. These grooves may have either a V-shaped cross-section as shown in FIG. 4 or a rectangular cross-section as shown in FIG. 5. Other opposite side face surfaces which are advantageous in improving the close contact between the synthetic resin plates and the rotor are shown in FIGS. 6 through 10. The dovetail cross-section concentric annular grooves shown in FIG. 10** are particularly effective.

Figure 11:
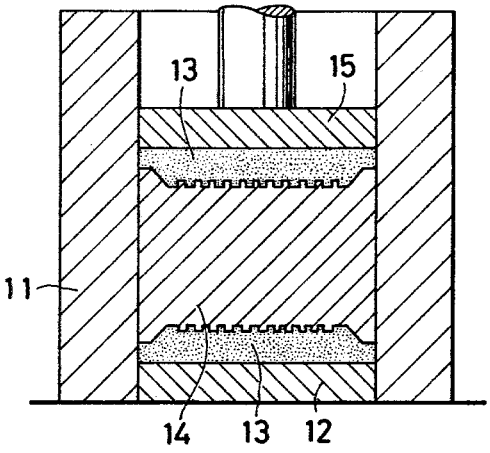
FIG. 11 is a cross-sectional view schematically illustrating a device for producing the rotors shown in FIGS. 4 to 10.

FIG. 11 illustrates means for molding the synthetic resin plates to the opposite side faces of the rotor member **6'*a*. In FIG. 11, a heat cylinder 11 has the same inside diameter as the outer diameter of the rotor member 14. The molding of the synthetic resin to the oppsite side faces of the rotor is accomplished by disposing a lower mold 12 in the cylinder 11, charging synthetic resin particles 13 in the cylinder, inserting the rotor member in the cylinder, charging synthetic resin particles in the cylinder, and pressing by the use of an upper mold 15** under a high temperature and a high pressure for a certain time. The rotor member produced in the above-mentioned manner is then formed with a shaft hole and vane grooves.

As described the above, the side plates are made of ferrous metal such as cast iron or steel or nonferrous metal such as aluminium alloy, the thickness of the side plates to be applied to the present invention is determined in view of the pressure change of the pump, coefficient of thermal expansion, wear resistance, and diameter of the rotor chamber. Particularly, in view of the coefficient of thermal expansion and ductility of the side plates, the thickness of the side plates made of ferrous metal is generally 1½ times as large as that of plates made of aluminum. Generally, the thickness of the side plates is preferably in a range of 1 to 5 mm.

Alternatively, the rotor side plates **6'*b*** may be composed mainly of carbon with a resin binder. In the manufacture of such plates, amorphous carbon such as lamp black is first dried and preheated. Then the carbon lumps are milled to form a powder which is mixed with a resin binder such as tar pitch. The mixture is milled and thereafter pressed by a roller to the desired thickness and sintered at a temperature in the range of 800° to 1200° C. Since rotor plates made according to this procedure have carbon as their main component, they will be referred to as carbon plates to distinguish them from the earlier described synthetic resin plates, which will be simply referred to hereinafter as resin plates.

If the entire rotor is made of synthetic resin, as shown in the embodiment illustrated in FIG. 2, there is a probability of excessive pressure against the side plates by the rotor due to the thermal expansion of the rotor resulting in the early formation of a stepped portion. Further, the engagement between the shaft and the rotor may be unstable due to the thermal expansion of the rotor. And therefore, in case of the application of the pump to a motor vehicle, the pumps as shown in FIGS. 3 to 10 are preferable. Similarly, if the entire rotor is made of amorphous carbon, the rotor may be broken due to the pressurized engagement between the rotor and the shaft, and the engagement therebetween may be unstable, which causes the axial sliding movement of the rotor with respect to the shaft. Further, the side plates may not follow the movement of the rotor, and the side plates may become partly worn out. And therefore, it is preferable to use the pumps shown in FIGS. 3 to 10 if the pump is used in a motor vehicle.

It is preferable that the rotor plates have a thickness S in the range of about 0.3 to about 2 mm since a thickness less than 0.3 mm will be subject to a great amount of wear and a thickness more than 2 mm is unnecessary to attain the object of the present invention. Particularly, if the thickness of the rotor plates made of synthetic resin exceeds 2 mm, the pressure contact of the side plates with the end faces of the rotor plates becomes excessive due to the thermal expansion of the rotor plates, so that the side plates and the rotor plates are prematurely worn out. Further, since the rotation of the pump is changed between the ranges of idling rotation (500 to 1500 rpm) and normal rotation (2,000 to 4,000 rpm), the side plates may contract when the rotation is changed from normal rotation to idling rotation. As a result, the side plates may not sufficiently contact the rotor plates in response to pressure changes of the rotor chamber if the rotation is reduced. Therefore, the wear of the rotor plates due to the normal rotation causes an undesirable clearance between the side plates and the rotor plates in idling rotation resulting in deteriorating sealability therebetween.

The thickness of the rotor plates made of synthetic resin is also determined in view of the relationship between the thermal expansion and the adhesivity of the rotor plates to the end faces of the rotor within the above-mentioned range. Namely, the thickness S is selected from the following formula: $S=(0.003\sim0.008)\times D$, where S is the thickness of the rotor plate and D is the diameter of the rotor. In this range, if synthetic resin plates having a large thermal expansion are applied to a rotor having a large diameter, a small value should be selected from the range of 0.003 to 0.008, and if synthetic resin plates having a small thermal expansion ratio are applied to a rotor having a small diameter, a large value should be selected.

The side plate and the plate affixed to the rotor side faces may be formed of the following materials in combination:

| Side Plate | Rotor Plate |
|---|---|
| ferrous metal | resin plate |
| ferrous metal | carbon plate |
| nonferrous metal | resin plate |
| nonferrous metal | carbon plate |

More specifically, as examples of ferrous metals which may be used as side plate materials, the following are considered preferable:

| FC 25 as defined by Japanese Industrial Standard JIS G 5501 and comprising cast iron consisting of | | |
|---|---|---|
| C: | less than 3.6% | wt. % |
| Si: | less than 2.6% | |
| Mn: | less than 0.8% | |
| P: | less than 0.1% | |
| S: | less than 0.1% | |
| Cu: | less than 0.5% | |
| Cr: | less than 0.35% | |
| | remainder Fe | |

| SK 5 as defined by Japanese Industrial Standard JIS G 4401 and comprising steel consisting of | | |
|---|---|---|
| C: | 0.80 ~ 0.90% | wt. % |
| Si: | less than 0.35% | |
| Mn: | less than 0.50% | |
| P: | less than 0.030% | |
| | remainder Fe | |

An example of a nonferrous metal which is considered preferable as a side plate material is the following:

| AC 7A as defined by Japanese Industrial Standard JIS H 5202 and comprisingan aluminum alloy casting consisting of | | |
|---|---|---|
| Cu: | less than 0.1% | wt. % |
| Si: | less than 0.3% | |
| Mg: | 3.5 ~ 5.5% | |
| Zn: | less than 0.1% | |
| Fe: | less than 0.4% | |
| Mn: | less than 0.6% | |
| Ti: | less than 0.2% | |
| | remainder Al | |

Preferred resin plate compositions are as follows:
graphite 20% by weight,
ethylene tetrafluoride 20% by weight, and
remainder polyimide, or amorphous carbon 20% by weight,
graphite 20% by weight, and
remainder polyimide.

As described above, in the present invention, since the side plate is formed of a material having a wear-resistance higher than that of the rotor, the wear of the side plate face in contact with the rotor becomes extremely low. Thus, no stepped portion to obstruct the outward radial movement of the vane is formed, and a good seal can be maintained for a long period of time. Since the pump of the present invention is of the type bringing the side plates into close contact with the rotor side faces by the pressure difference between the rotor chamber and the end chambers, the sealing effect is not reduced even when the rotor side faces are subject to wear. Furthermore, the pump of the present invention can be operated smoothly without lubricant by making the rotor or the rotor side faces out of carbon or a synthetic resin having a self-lubrication property and making the side plates out of a ferrous or nonferrous metal.

The results of comparison tests between a rotary fluid pump of the present invention and a conventional pump are shown as follows:

| Dimensions of the Tested Pumps | | |
|---|---|---|
| (inner diameter of the housing) | × | (axial length of the housing): |
| 80.00mm | × | 60.06mm |
| (inner diameter of the rotor) | × | (axial length of the rotor): |
| 72.00mm | × | 60.00mm |
| the number of vanes: 4 | | |
| axial depth of the end chambers: 1mm | | |

A pair of projections are formed at the central portion of the end heads as shown by A in FIG. 2. The exhaust pressure from the outlet port O is introduced into the pair of end chambers to establish a pressure differential between the rotor chamber and the end chambers to urge the side plates toward the end faces of the rotor.

| Conventional Compression Pump: | | |
|---|---|---|
| (corresponding to the pump disclosed in S.N. 635,459) | | |
| side plate thickness | 3 mm | |
| side plate material | graphite | 20% by weight |
| | ethylene tetra-fluoride | 20% by weight |
| | polyimide | remainder |
| rotor material | FC 25 | |

| First Compression Pump of the Present Invention: | |
|---|---|
| side plate thickness | 1.8 mm |
| side plate material | FC 25 |
| rotor plate material | Resin plates are deposited on opposite faces of the rotor. The resin plates consist of 20% by weight of graphite, 20% by weight of ethylene tetrafluoride, and the remainder of polyimide; the thickness of plates is 2 mm. |

| Second Compression Pump of the Present Invention: | |
|---|---|
| side plate thickness | 1.8 mm |
| side plate material | FC 25 |
| rotor plate material | Carbon plates are deposited on opposite sides of the rotor. The plates comprise amorphous carbon such as lamp black which is first dried and pre-heated. Then the carbon lumps are milled to form a powder which is mixed with a resin binder such as tar pitch. The mixture is milled and thereafter pressed by a roller to the plate thickness of 0.3 mm and sintered at a temperature in the range of 800° to 1200° C. |

| Third Compression Pump of the Present Invention: | |
|---|---|
| side plate thickness | 1.8 mm |
| side plate material | FC 25 |
| rotor plate material | Similar to the second compression pump but with the addition of fillers of 2% by weight of ceramic and 13% by weight of iron tetroxide. |

Comparison tests have been conducted on two compression pumps of each type, one operated at 1000 rpm and the other operated at 5000 rpm under the following conditions:

(1) 600 hours continuous running without lubricant (2) load pressure: 0.6 kg/cm$^2$ (3) without cooling by the use of a fan The test results are shown in FIG. 12. The exhaust flow amount of the conventional compression pump operated at 1000 rpm was gradually reduced after 100 hours and the pump became unusable after 375 hours. This was due to a 0.3 mm stepped portion created in the side plate which obstructed outward radial movement of the vanes to an extreme extent. On the other hand, the exhaust flow amount of the three compression pumps of the present invention was maintained high and the pumps withstood the 600 hours of running. In each of the compression pumps of the invention, only a 0.005 mm stepped portion was created in the side plate, and the pump was sufficiently usable. In the conventional compression pump operated at 5000 rpm, its exhaust flow amount was gradually reduced and the vanes are broken after 415 hours. This was due to the vanes being caught by the 0.6 mm stepped portion which was created. On the other hand, in the compression pumps of the present invention operated at 5000 rpm, its exhaust flow amount remained high and the pump withstood the 600 hours of running. In each of the compression pumps of the invention, only 0.1 mm stepped portion was created in the side plate, and the pump was sufficiently usable.

Therefore, it is apparent that the compression pump of the present invention has a durability several times higher than the conventional compression pump.

What is claimed is:

1. In a rotary fluid pump of the type including a rotor supported in a rotor chamber defined by a stator housing and two end heads, two flexible side plates each interposed between the housing and each of the end heads to form end chambers between the side plates and the end head, the end chambers being supplied with a pressure higher than that in the rotor chamber so as to bring the side plates into close contact with the opposite side faces of the rotor during rotor operation, the improvement wherein the rotary fluid pump comprises flexible metal side plates and the rotor is formed of a metal member having affixed to its opposite side faces rotor plates which are about 0.3 to 2 mm thick and are formed of a synthetic resin material having an abrasion resistance lower than that of said metal.

2. In a rotary fluid pump of the type including a rotor chamber defined by a stator housing and two end heads, two flexible side plates each interposed between the housing and each of the end heads to form end chambers between the side plates and the end head, the end chambers being supplied with a pressure higher than that in the rotor chamber so as to bring the side plates into close contact with the opposite side faces of the rotor during rotor operation, the improvement wherein the rotary fluid pump comprises flexible side plates formed of a metal and the rotor is formed of a metal member having affixed to its opposite side faces rotor plates which are bout 0.3 to 2 mm thick and are composed mainly of carbon with a resin binder material having an abrasion resistance lower than that of said metal.

3. In a rotary fluid pump of the type including a rotor supported in a rotor chamber defined by a stator housing and two end heads, two flexible side plates each interposed between the housing and each of the end heads to form end chambers between the side plates and the end head, the end chambers being supplied with a pressure higher than that in the rotor chamber so as to bring the side plates into close contact with the opposite side faces of the rotor during rotor operation, the improvement wherein the rotory fluid pump comprises flexible side plates on the order of 1.8 mm thick and formed of cast iron, and the rotor is formed of a metal member having affixed to its opposite side faces rotor plates which have a thickness on the order of 2 mm and are formed of approximately 20 percent by weight of graphite, approximately 20 percent by weight of ethylene tetrafluoride, and the remainder of polyimide.

* * * * *